US006349855B1

(12) United States Patent
Borri

(10) Patent No.: US 6,349,855 B1
(45) Date of Patent: Feb. 26, 2002

(54) BOTTLE, IN PARTICULAR FOR PERFUME, WITH SLIDABLE COVER ELEMENT FOR THE PRODUCT DISPENSER PART

(75) Inventor: Giovanni Borri, Roncopascolo (IT)

(73) Assignee: Henkel S.p.A., Ferentino (IT)

( * ) Notice: Subject to any disclaimer, the term of this patent is extended or adjusted under 35 U.S.C. 154(b) by 0 days.

(21) Appl. No.: 09/567,779

(22) Filed: May 9, 2000

(30) Foreign Application Priority Data

Jun. 4, 1999 (IT) ..... MI99U0361

(51) Int. Cl.[7] ..... B65D 83/00

(52) U.S. Cl. ..... 222/182; 222/402.11; 222/402.12; 222/402.13

(58) Field of Search ..... 222/182, 402.11, 222/402.12, 402.13, 560

(56) References Cited

U.S. PATENT DOCUMENTS 3,469,746 A * 9/1969 Melocchi ..... 222/182
3,510,029 A * 5/1970 Doyle ..... 222/402.12
3,618,827 A * 11/1971 Melocchi ..... 222/182
3,848,778 A * 11/1974 Meshberg ..... 222/402.11

* cited by examiner

*Primary Examiner*—J. Casimer Jacyna
(74) *Attorney, Agent, or Firm*—Steinberg & Raskin, P.C.

(57) ABSTRACT

A bottle (1), in particular for perfume, comprises a body (2) having a portion (3) acting as the container for the product, for example perfume, this portion (3) being provided with a delivery part (6) comprising a spray dispenser element (7) positioned on an aperture (5) in the part (6). The product delivery part (6) is encased between lateral shoulders (4) of the bottle (1), between these shoulders there sliding a cover element (8) for the part (5), to lie superposed on this latter, the element (8) being able to assume two positions, in a first of which it prevents product delivery and in a second of which it allows this delivery.

9 Claims, 3 Drawing Sheets

BOTTLE, IN PARTICULAR FOR PERFUME, WITH SLIDABLE COVER ELEMENT FOR THE PRODUCT DISPENSER PART

FIELD OF THE INVENTION

The present invention relates to a bottle, in particular, to a bottle for holding and dispensing perfume.

BACKGROUND OF THE INVENTION

Bottles of the most varied shapes are used for a very wide range of products. With non-limiting reference to bottles for liquids and in particular perfumes, these usually comprise a body with a portion acting as the perfume container and a dispenser part. This part has an aperture closed by a closure element or cap (usually screwed). On this aperture there can instead be positioned a spray dispenser element on which a snap closure element is usually positioned covering either the dispenser element alone or the entire dispenser part. Both in this latter case and in the case of a cap, when using the perfume, for which the closure element has to be removed, this element can fall or the user can forget to replace it on the bottle, with obvious inconvenience.

The closure element can also be lost during bottle transport, causing evident problems.

Moreover, in known bottles, two hands have always to be used to remove the closure element, sometimes making it difficult to use the product contained in the bottle.

OBJECTS AND SUMMARY OF THE INVENTION

An object of this invention is to provide an improved bottle.

A particular object of the invention is to provide a bottle of the stated type in which there is no risk of losing the closure element when using the product contained in it.

A further object is to provide a bottle in which the product contained in it can be used easily and quickly without the user necessarily having to have both hands free.

A particular object is to provide a bottle of the stated type in which any spray dispenser element is properly protected to prevent involuntary dispensing of the product contained in the bottle.

These and further objects which will be apparent to an expert of the art are attained by a bottle in accordance with the attached claims.

BRIEF DESCRIPTION OF THE PREFERRED EMBODIMENTS

The invention will be more apparent from the accompanying drawings, which are provided by way of non-limiting example and on which:

Figure 1:
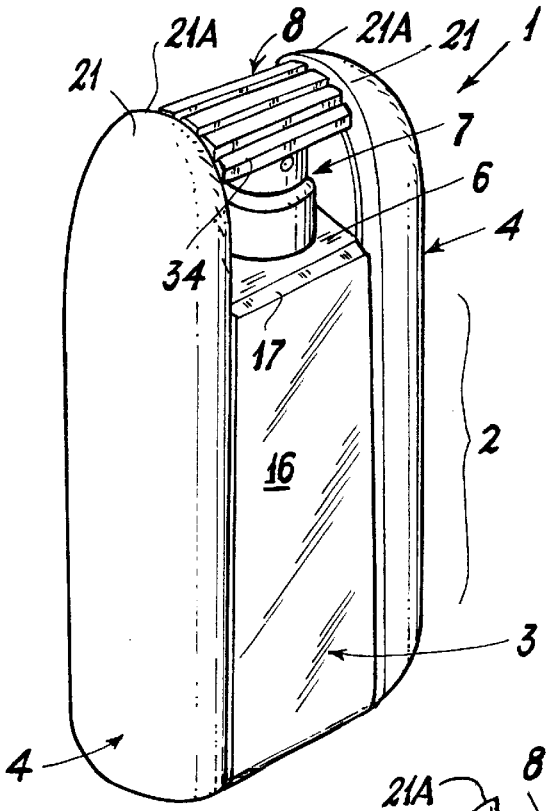
FIG. 1 is a perspective view of a bottle of the invention with its movable part in an intermediate operating position.
Figure 2:
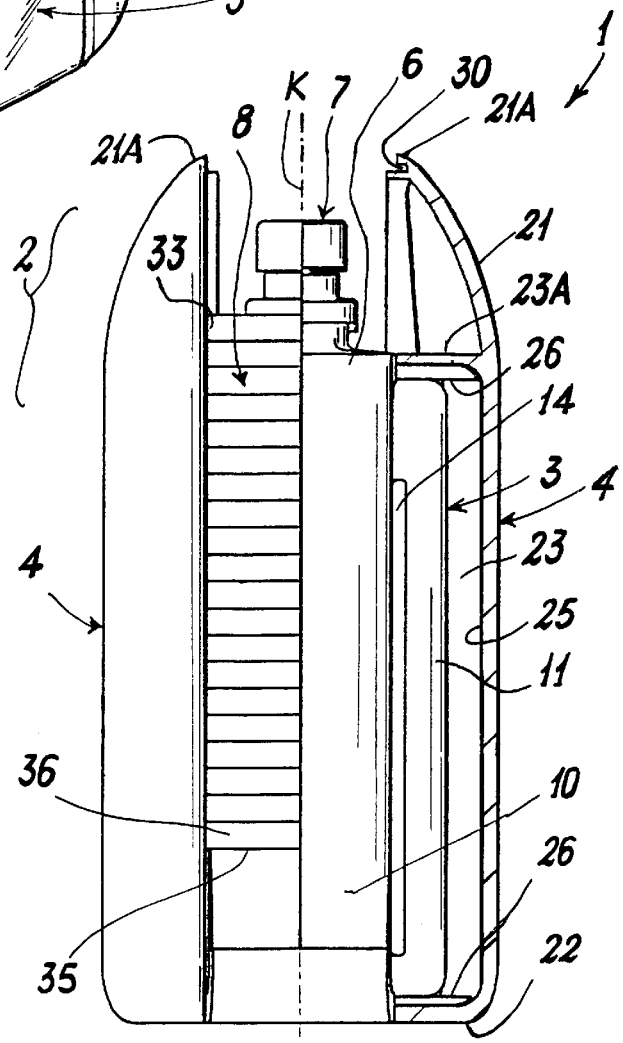
FIG. 2 is a rear view, shown half in section, of the bottle of FIG. 1.
Figure 3:
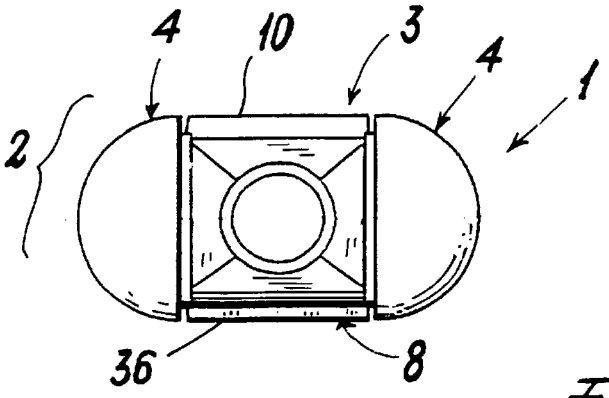
FIG. 3 is a view of the bottle of FIG. 1 from above, with the movable part in an end operating position.
Figure 4:
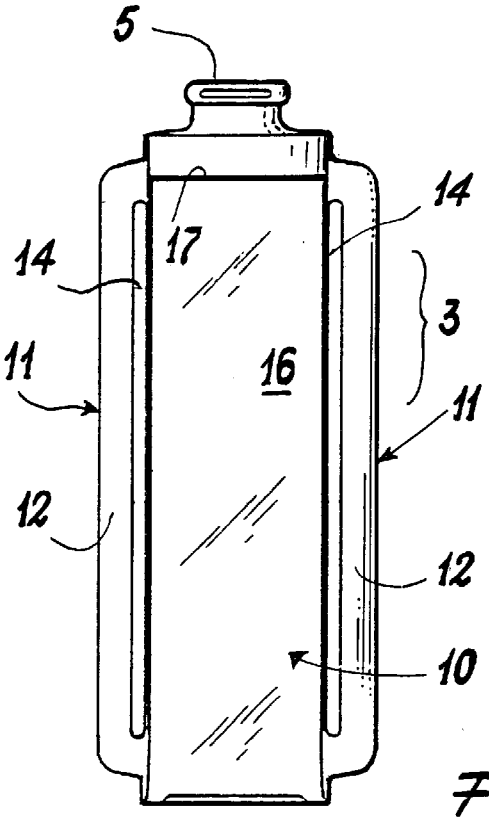
FIG. 4 is a front view of a part of the bottle of FIG. 1.

With reference to said figures, a bottle for a liquid product, such as a perfume, is indicated overall by 1 and comprises a body 2. This body has a portion 3 acting as the perfume container positioned between lateral portions or shoulders 4. The portion 3 has a part 6 through which the product contained in it is delivered. The part 6 is provided with an aperture 5 on which a spray dispenser element 7 is positioned. This element is positioned substantially encased between the lateral shoulders 4, and over it there is provided, movable along said shoulders, a cover element 8 arranged to assume two operating positions, in a first of which it prevents access to the dispenser 7, and in the other of which it allows this access and hence enables the perfume to be used.

Figure 5:
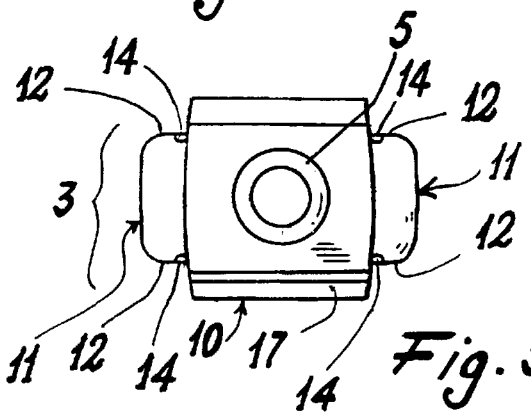
FIG. 5 is a view of that part of the bottle of FIG. 4 from above.
Figure 6:
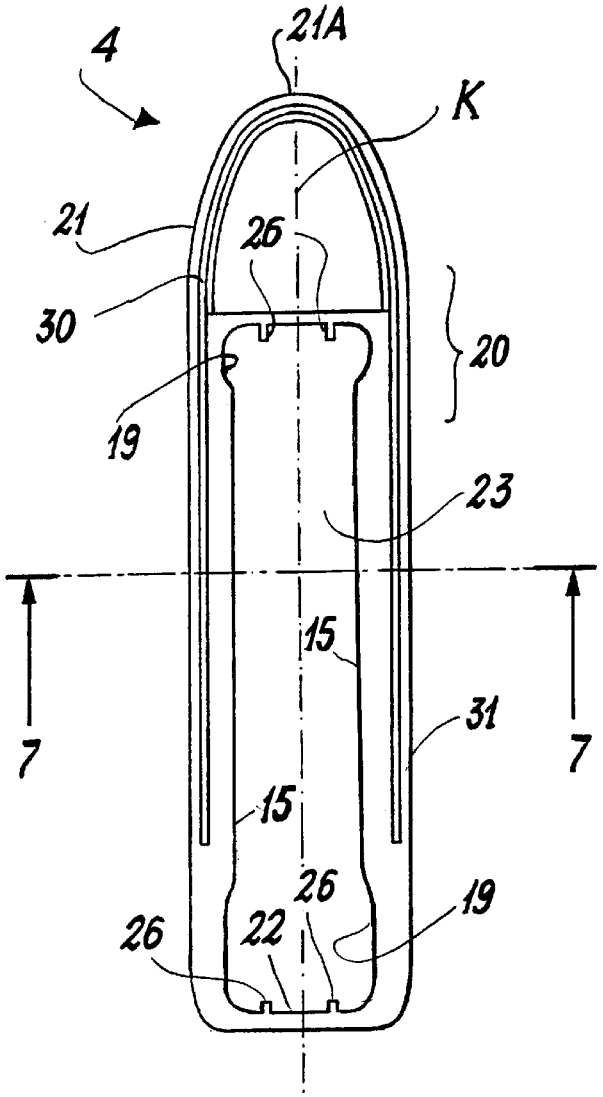
FIG. 6 is a front view of another part of the bottle of FIG. 1.
Figure 7:
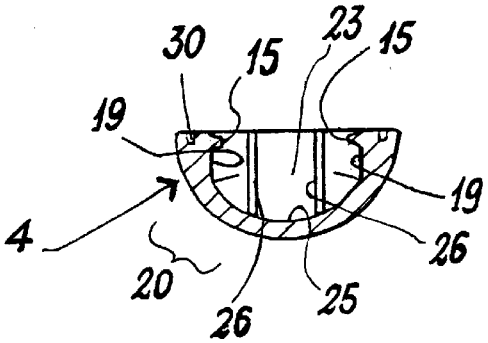
FIG. 7 is a section on the line 7—7 of FIG. 6.

Specifically, the portion 3 containing the perfume comprises a central part 10 and lateral parts or arms 11 having a smaller cross-section (see FIG. 5) than the part 10. Along opposite sides 12 of the arms 11, in proximity to the part 10, longitudinal recesses 14 are provided to snap-receive undercuts 15 provided on opposing sides 19 of the corresponding shoulders 4. Finally, a step 17 is provided on one face 16 of the part 10 of the portion 3.

The shoulders 4 each have a substantially ogival hollow body 20 with a curved upper portion 21 and flat lower portion 22. The shoulders 4 are of elongate shape having a length greater than the height of the portion 3. In this manner, the delivery part 6 of the bottle 1 is encased within said shoulders, it lying between them in a plane lower than the plane tangential to the top 21A of the portion 21 of the shoulders.

A corresponding arm 11 of the portion 3 is positioned in the cavity 23 of the body 20, this cavity being defined by a wall 25 and the sides 19 provided with the undercuts 15. A baffle 23A is provided parallel to the lower portion 22 in this cavity, from the baffle and lower portion there projecting ribs 26 extending towards the cavity 23 and arranged to cooperate with the corresponding arm 11 in order to retain it and prevent its longitudinal movement (ie along a longitudinal axis K of this shoulder) within the cavity 23. The shoulder and the portion 3 are connected together by inserting of the undercuts 15 into said recesses 14.

Each shoulder 4 also has a continuous recess 30 along a large part of its peripheral edge 31 to involve the sides 19 and the portion 21. An end 33 of the cover element 8 is arranged to move within the recess 30. In other words, the recesses 30 in the shoulders 14 define, when these are connected, guides in which the element 8 slides on the body 2 of the bottle.

The cover element 8 is of the "roll shutter" type, having a first free end 34, and a second free end 35 provided with a jutting portion 36 acting as a gripping element for the "shutter", when sliding it within the guide defined by the recesses 30 on the shoulders 4, from a position in which the end 34 rests on the step 17 on the part 10 of the portion 3, to a position in which the "shutter" lies along the body 2 of the bottle 1. When in the first position the "shutter" element 8 is curved above the delivery part 6 of this body and above the element 7 present thereon. In this position it closes access to this element and hence acts as a cap or closure member for the container. When in the second position it enables the dispenser element 7 to be used to dispense the perfume. The element 8 can be easily moved along its guide, the user being able to achieve this movement and dispense the perfume with one and the same hand.

The invention avoids having to use on the bottle a closure or protection element for the spray dispenser (if used), which can cause problems in terms of its undesired detachment from the bottle or forgetfulness in replacing it. In addition, the aforedescribed solution protects the dispenser element and the metal or metallized parts associated with it from dust, which would have an aesthetically undesirable effect on these parts.

A particular embodiment of the invention has been described. Others are however possible. For example, the cover element can comprise two parts independently movable in opposing directions along the shoulders 4, or alternatively the element 8 can be of bellows type slidable along the shoulders. These variants are also to be considered as falling within the scope of the invention.

What is claimed is:

1. A bottle in particular for perfume, comprising a body (2) having a portion (3) acting as the container for the product, for example perfume, this portion (3) being provided with a delivery part (6) comprising a spray dispenser element (7) positioned on an aperture (5) in the part (6), wherein the product delivery part (6) is encased between lateral shoulders (4) of the bottle (1), between these shoulders there sliding a cover element (8) for the part (5), to lie superposed on this latter, the element (8) being able to assume two positions, in a first of which it prevents product delivery and a second of which it allows this delivery, and wherein the cover element slides along guides (30) defined in the lateral shoulders (4) of the bottle (1).

2. A bottle as claimed in claim 1, wherein each guide is defined by a continuous recess (30) provided along an edge of each lateral shoulder (4).

3. A bottle as claimed in claim 1, wherein the cover element is of roll shutter type.

4. A bottle in particular for perfume, comprising a body (2) having a portion (3) acting as the container for the product, for example perfume, this portion (3) being provided with a delivery part (6) comprising a spray dispenser element (7) positioned on an aperture (5) in the part (6), wherein the product delivery part (6) is encased between lateral shoulders (4) of the bottle (1), between these shoulders there sliding a cover element (8) for the part (5), to lie superposed on this latter, the element (8) being able to assume two positions, in a first of which it prevents product delivery and a second of which it allows this delivery, wherein the lateral shoulders (4) are snap-connected to that portion (3) of the bottle (1) acting as the product container and wherein the portion (3) containing the product container and wherein the portion (3) containing the product comprises a central part (10) and lateral parts (11), along opposite sides (12) of these latter (11) there being provided recesses (14) for snap-receiving projections (15) extending from opposites sides (19) of a corresponding lateral shoulder (4), these sides (19) and a part (25) of said shoulder (4) which connects them together defining a recess (23) for receiving the respective lateral part (11) of that bottle portion (3) containing the product.

5. A bottle as claimed in claim 4, wherein means (26) are provided within the recess (23) of each shoulder to lock the corresponding lateral part (11) of that bottle portion (3) containing the product to prevent its longitudinal movement along an axis (K) of the shoulder.

6. A bottle as claimed in claim 5, wherein each shoulder is of ogival shape and comprises a curved first end portion (21) in correspondence with the delivery part (6) of the bottle (1), and a flat second end portion (22).

7. A bottle as claimed in claim 4, wherein the central part (10) of that bottle portion (3) containing the product comprises a ste (17) on one face or side (16), on this step there resting the cover element (8) when in that working position in which it prevents use of the dispenser element (7).

8. A bottle comprising:

a body having a central portion for holding a liquid, said central portion having a open top, first and second lateral shoulders arranged on either side of said central portion;

a spray dispenser element coupled to said bottle to cover and communicate with said open top, said first and second shoulders being structured and arranged to vertically extend above a top surface of said spray dispenser element;

a slidable cover structured and arranged to be received between said first and second shoulders and to cover said spray dispenser element, said slidable cover being slidable between a first position wherein said slidable cover prevents a dispensing of said liquid and a second position permitting the dispensing of said liquid, wherein said slidable cover is structured and arranged to slide along an arcuate path from said first position to said second position and wherein said cover is received within and slides along guides defined in said first and second lateral shoulders.

9. A bottle according to claim 8, wherein said first and second lateral shoulders are structured and arranged to be snap fitted to said central portion.

* * * * *